United States Patent [19]

Soes

[11] 3,960,434

[45] June 1, 1976

[54] ELECTRICAL CONNECTOR ASSEMBLY

[75] Inventor: Lucas Soes, Vught, Netherlands

[73] Assignee: AMP Incorporated, Harrisburg, Pa.

[22] Filed: Feb. 6, 1975

[21] Appl. No.: 547,678

[30] Foreign Application Priority Data

Feb. 14, 1974 Netherlands ..... 7402028

[52] U.S. Cl. ..... 339/176 M; 339/258 P

[51] Int. Cl.[2] ..... H01R 11/22

[58] Field of Search ..... 339/176 R, 176 M, 252 P, 339/258 R, 258 C, 258 F, 258 P

[56] References Cited

UNITED STATES PATENTS

| | | | |
|---|---|---|---|
| 3,551,750 | 12/1970 | Sterling | 339/176 M |
| 3,588,785 | 6/1971 | Hardardf | 339/176 M |

FOREIGN PATENTS OR APPLICATIONS

| | | | |
|---|---|---|---|
| 6,702,470 | 8/1967 | Netherlands | 339/258 R |
| 695,161 | 8/1953 | United Kingdom | 339/176 M |

*Primary Examiner*—Roy Lake
*Assistant Examiner*—Mark S. Bicks
*Attorney, Agent, or Firm*—William J. Keating; Jay L. Seitchik; Frederick W. Raring

[57] ABSTRACT

An electrical connector assembly includes a male contact having cantilever contact springs diverging rearwardly from a forward yoke portion to a position of maximum divergence and a female contact having cantilever contact springs extending forwardly from a yoke portion. The male and female contacts engage by outward flexure of the contact springs of the female contact and concomitant inward flexure of the contact springs of the male contact.

5 Claims, 5 Drawing Figures

ELECTRICAL CONNECTOR ASSEMBLY

The present invention relates to electrical connector assemblies and especially to electrical connector assemblies for use in the electronics industry.

According to the present invention, an electrical connector assembly comprises a forked female contact having a pair of spaced cantilever contact springs extending from a yoke portion with inwardly directed lobes at their free ends receiving a complementary male contact, the male contact including a forward yoke portion with a pair of rearwardly directed, spaced cantilever contact springs diverging rearwardly from the yoke portion towards their free ends, the male contact entering the female contact by outward flexure of the contact springs of the female contact and inward flexure of the contact springs of the male contact, the flexure of the contact springs of the male contact being such that they extend rearwardly from the male yoke portion in divergent manner to an outer position and then extend inwardly in convergent manner to be engaged by the lobes of the contact springs of the female contact.

An embodiment of the invention will now be described, by way of example, reference being made to the Figures of the accompanying diagrammatic drawings in which.

Figure 1:
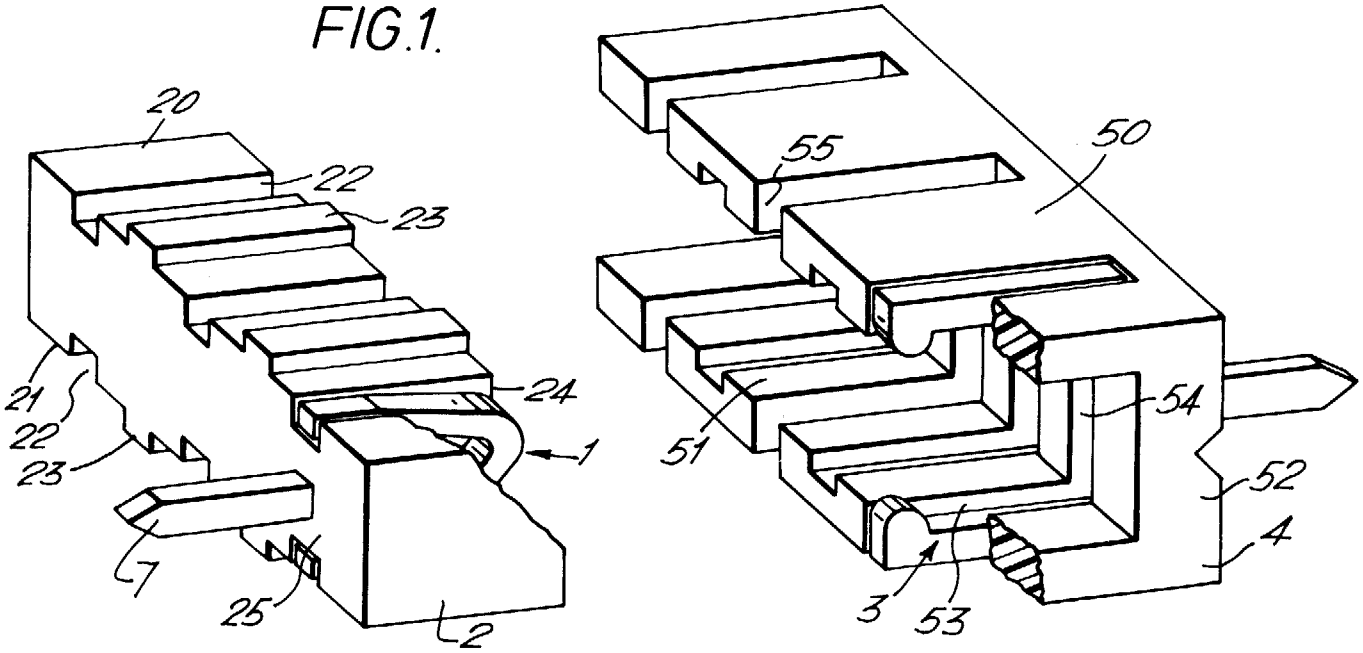
FIG. 1 is a perspective view of two electrical connectors which when mated form an electrical connector assembly.

As shown, an electrical connector assembly includes at least one male electrical contact 1 mounted in a housing 2 and engaging at least one mating female electrical contact 3 mounted in a housing 4.

The male contact 1 which is blanked and formed from sheet metal comprises a forward yoke portion 6 with first and second substantially identical cantilever contact springs 5 diverging rearwardly from the yoke portion 6 towards their free ends. Extending in the same sense from the yoke portion 6 as the contact springs 5 and between the contact springs 5 is a post 7. Each contact spring 5 has a first portion 8 extending from a side of the yoke portion 6 and a second portion 9 which is angled with respect to the first portion 8. The second portion 9 has a first part 10 immediately adjacent the first portion 8 having an outside side surface 11 which diverges with respect to the outside side surface of its opposite part 10 to a position 12 of maximum divergence. A second part 13 of the portion 9 has an outside side surface 29 which is generally parallel in the undeformed state of the male contact 1 with the direction of mating of the contacts 1, 3. The second part 13 includes an abutment extending inwardly of the male contact 11 which defines a stop surface 14.

The housing 2 comprises a generally rectangular block of insulating material having upper and lower surfaces 20, 21 as shown in FIG. 1. Alternate slots 22 and abutments 23 are formed on the surfaces 20, 21 and extend from a mating front surface 24 to an opposite rear surface 25. Through holes 26 are also provided between the surfaces 24, 25 each hole 26 being in alignment with a pair of slots 22.

Figure 2:
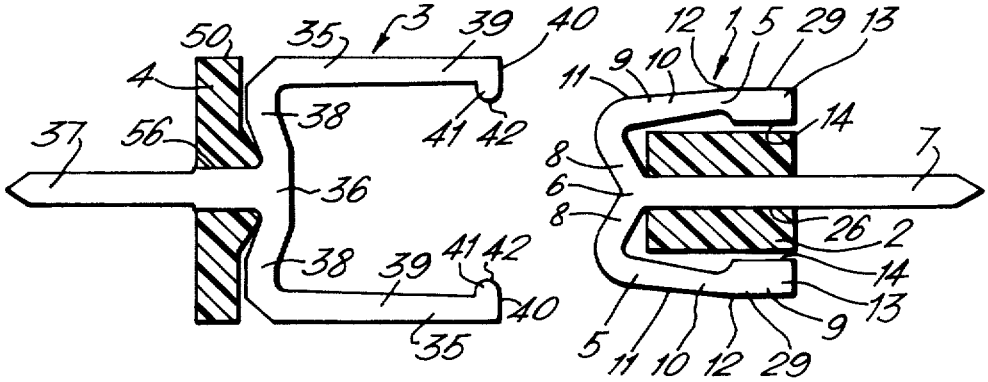
FIG. 2 is a side elevation partly in cross-section of the electrical connectors of FIG. 1.

On assembly of a male contact 1 in a housing 2, the post 7 extends through a hole 26 with a tight fit so that the yoke portion 6 engages the mating forward surface 24 of the housing 2. Second portions 9 of the contact springs 5 are each received in one of a pair of slots 22. As shown in FIG. 2, there is clearance between the base of each slot 22 and its respective second portion 9.

The female contact 3 which is stamped and formed from sheet metal comprises first and second substantially identical cantilever contact springs 35 extending from a yoke portion 36. Extending from the yoke portion 36 in a sense opposite to that of the contact springs 35 is a post 37. Each contact spring 35 has a first portion 38 extending from a side of the yoke portion 36 and a second portion 39 which is angled with respect to the first portion 38. The second portion 39 is relatively wide adjacent the first portion 38 and tapers to a relatively thin free end 40. At its free end 40, each second portion 39 has an inwardly directed lobe 41 which defines a contact surface 42. In the undeformed state of the female contact 3 the second portions 39 are generally parallel with the direction of mating of the contacts 1, 3.

The housing 4 has upper and lower walls 50, 51 (as shown in FIG. 1) interconnected by an end wall 52 to define a generally U-channel section. The walls 50, 51, 52 each have a plurality of aligned slots 53, 54, 55 in which female contacts 3 are received. Extending through the end wall 52 is a hole 56.

On assembly of a female contact 3 in a housing 4, the post 37 extends through a hole 56 with a tight fit so that the second portions 39 are received in slots 53, 55 and the first portions 38 together with the yoke portion 36 are received in the slot 54.

Figure 3:
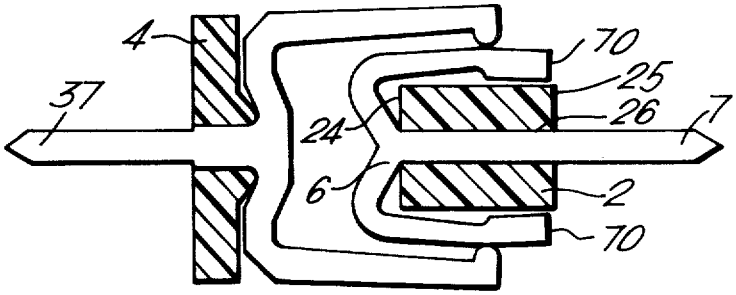
FIGS. 3 and 4 are views similar to FIG. 2 but showing the electrical connectors in varying degrees of mating engagement.
Figure 4:
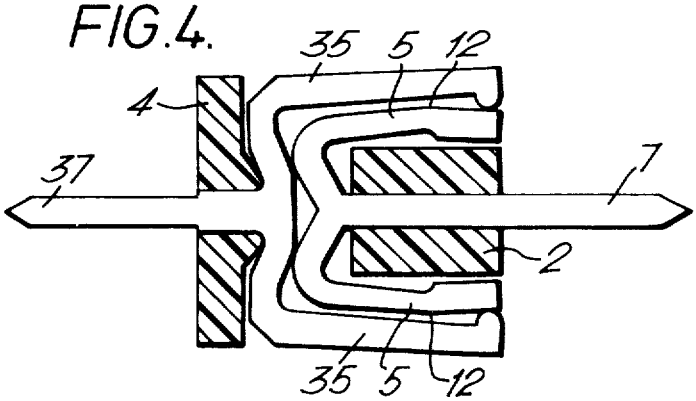
Figure 5:
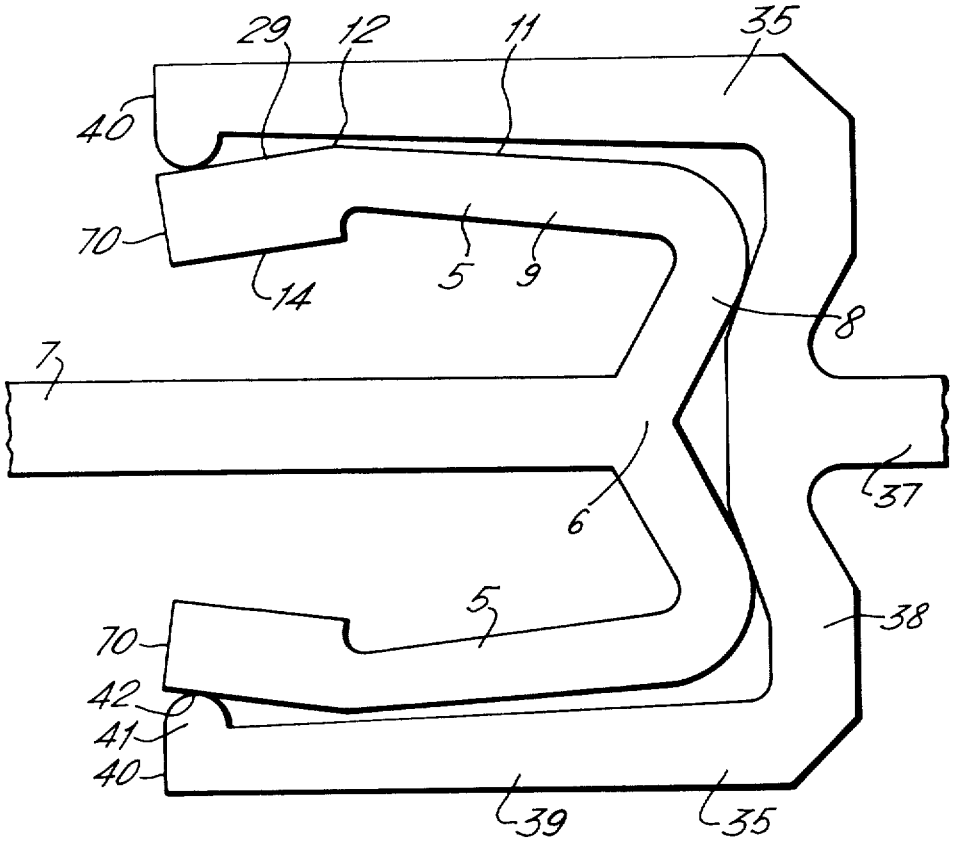
FIG. 5 is an enlarged view of a detail of FIG. 4.

On mating, the housing 2 together with he male contact 1 enters the housing 4 so that the contact surfaces 42 engage and move axially with respect to the outside side surfaces 11 of the second portions 9. The contact springs 5 flex inwardly and the contact springs 35 flex outwardly. At a maximum deflection, as shown in FIG. 3, the contact surfaces 42 engage the positions 12 of maximum divergence. Further axial movement of the male contact 1 within the female contact 3 causes the contact surfaces 42 to engage the surfaces 29 as shown in FIG. 4.

One advantage of the electrical connector assembly described above is that the force exerted between a contact spring 5 and a contact spring 35 is transmitted by a contact surface 42 and an outside side surface 29. As can be seen from FIG. 4, the force will have a component directed inwardly of the female contact 3 towards the base 36. This component resists withdrawal of the male contact 1 from the female contact 3.

A further advantage is that a force greater than the normal contact force must be applied to disconnect the male contact 1 from the female contact 3 since the positions 12 are spaced apart farther then the outside side surfaces 29. This feature acts as a safeguard against any tendency of the contacts to disconnect due to vibration. The upper and lower surfaces 20, 21 of the housing 2 together with the stop surfaces 14 inhibit any likelihood of the contact arms 5 being overstressed.

A still further advantage of both the male and female contacts 1, 3 is that they each have contact springs 5, 35 which can flex not only about their junction with a base 6, 36 but also about the junctions of the respective first portions 8, 38 with the second portions 9, 39. This adds to the flexibility of the electrical connector assembly.

What is claimed is:

1. An electrical connector assembly comprising a forked female contact having a pair of spaced cantilever contact springs extending from a yoke portion with inwardly directed lobes at their free ends receiving a complementary male contact, the male contact including a forward yoke portion with a pair of rearwardly directed, spaced cantilever contact springs diverging rearwardly from the yoke portion towards their free ends, the male contact entering the female contact by outward flexure of the contact springs of the female contact and inward flexure of the contact springs of the male contact, the flexure of the contact springs of the male contact being such that they extend rearwardly from the male yoke portion in divergent manner to an outer position and then extend inwardly in convergent manner to be engaged by the lobes of the contact springs of the female contact.

2. An assembly as claimed in claim 1, in which the contact springs of the male contact are substantially identical, each having a first portion extending from a side of the yoke and a second portion which is angled with respect to the first portion and which is engaged by the lobes of the female contact.

3. An assembly as claimed in claim 2, in which each contact spring of the male contact flexes about the junction of the first and second portions and the junction of the first portion and the yoke portion.

4. An assembly as claimed in claim 2, in which each second portion includes an inwardly directed abutment adjacent a free end of the second portion, which abutment defines a stop surface.

5. An assembly as claimed in claim 1 comprising a plurality of female contacts mounted in a first insulating housing and a plurality of male contacts mounted in a second insulating housing, each male contact having a post extending from the yoke portion between the contact springs, the post being received in a through hole in the second housing of insulating material, the contact springs extending from the yoke portion into slots on opposite surfaces of the second insulating housing.

* * * * *